US006210853B1

(12) United States Patent
Patel et al.

(10) Patent No.: US 6,210,853 B1
(45) Date of Patent: Apr. 3, 2001

(54) TONER AGGREGATION PROCESSES

(75) Inventors: Raj D. Patel, Oakville; Michael A. Hopper, Toronto; Emily L. Moore, Mississauga; Guerino G. Sacripante, Oakville, all of (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/657,340

(22) Filed: Sep. 7, 2000

(51) Int. Cl.[7] ..... G03G 9/087
(52) U.S. Cl. ..... 430/137
(58) Field of Search ..... 430/137

(56) References Cited

U.S. PATENT DOCUMENTS

| | | | |
|---|---|---|---|
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,482,812 | 1/1996 | Hopper et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/107 |
| 5,622,806 | 4/1997 | Veregin et al. | 430/137 |
| 5,650,255 | 7/1997 | Ng et al. | 430/137 |
| 5,650,256 | 7/1997 | Veregin et al. | 430/137 |
| 5,922,501 | 7/1999 | Cheng et al. | 430/137 |
| 5,945,245 | 8/1999 | Mychajlowskij et al. | 430/137 |
| 5,962,179 * | 10/1999 | Agur et al. | 430/137 |
| 6,120,967 * | 9/2000 | Hopper et al. | 430/137 |

* cited by examiner

*Primary Examiner*—Roland Martin
(74) *Attorney, Agent, or Firm*—E. O. Palazzo

(57) ABSTRACT

A process for the preparation of toner including (i) gerating by emulsion polymerization in the presence of an initiator a first resin latex emulsion; (ii) generating by polycondensation a second resin latex optionally in the presence of a catalyst; (iib) dispersing the resin of (ii) in water; (iii) mixing (iib) with a colorant thereby providing a colorant dispersion; (iiib) mixing the resin latex emulsion of (i) with the resin/colorant mixture of (iii) to provide a blend of a resin and colorant; (iv) adding an aqueous inorganic cationic coagulant solution of a polymeric metal salt and optionally an organic cationic coagulant to the resin/colorant blend of (iiib); (v) heating at a temperature of from about 5 to about 10 degrees Centigrade below the resin Tg of (i), to thereby form aggregate particles and which particles are optionally at a pH of from about 2 to about 3.5; (vi) adjusting the pH of (v) to about 6.5 to about 9 by the addition of a base; (vii) heating the aggregate particles of (v) at a temperature of from about 5 to about 50 degrees Centigrade above the Tg of the resin of (i), followed by a reduction of the pH to from about 2.5 to about 5 by the addition of an acid resulting in coalesced toner; (viii) optionally isolating the toner.

27 Claims, No Drawings

TONER AGGREGATION PROCESSES

COPENDING APPLICATION

Illustrated in copending application U.S. Ser. No. 09/657,273, filed concurrently herewith, the disclosure of which is totally incorporated herein by reference is a process for the preparation of toner comprising (i) generating by emulsion polymerization in the presence of an initiator a first resin latex emulsion; (ii) generating by solution polymerization in the presence of an oil soluble initiator a second resin latex; (iii) mixing (ii) with a colorant thereby providing a colorant dispersion; (iiib) mixing the resin latex emulsion of (i) with the resin/colorant mixture of (iii) to provide a blend of resin and colorant; (iv) adding an inorganic cationic coagulant solution of a metal salt, an organic cationic coagulant solution or mixtures thereof to the resin/colorant blend of (iiib); (v) heating at a temperature of from about 5° C. to about 10° C. below the latex resin Tg of (i) to form aggregate particles, and which particles are at a pH of from about 2 to about 4; (vi) adjusting the pH of (v) to about 6.5 to about 9 by the addition of a base; (vii) heating the aggregate particles at a temperature of from about 5° C. to about 50° C. above the Tg of the latex resin of (i), followed by a reduction of the pH to from about 2.5 to about 5 by the addition of an acid thereby resulting in coalesced toner; and (viii) optionally isolating the toner.

BACKGROUND OF THE INVENTION

This invention relates to toner processes, and more specifically to the preparation of a surfactant free latex wherein resin particles contained therein are aggregated and coalesced with a colorant to provide toner compositions. In particular, the present invention relates to a surfactant free toner process wherein the process involves the preparation of an latex emulsion preferably containing submicron resin particles suspended in an aqueous phase which is surfactant free, (ii) preparing by polycondensation a second resin which resin is readily dispersable in warm water to provide a dispersion of submicron particles in the size range of for example, about 50 to about 300 nm, wherein this dispersion is then used as a dispersant for the colorant particles to provide a stable colorant or colorant dispersion followed by aggregation and coalescence with the latex emulsion of (i) to provide a toner composition. The resin utilized to stabilize the colorant, such as pigment particles is for example, a sodio sulfonated polyester resin and which resin is capable of self dispersing in warm water providing a submicron particle size dispersion. More specifically the processes of the present invention can select dual coagulants such as an inorganic cationic metal salt and an organic cationic coagulant to facilitate aggregation of resin and colorant, such as pigment particles, both which are in the size range of about 80 to about 400 nanometers in size and optionally the use of a release agent such as a wax and a charge control agent. With further respect to the processes of the present invention is the staged raising of the temperature during coalescence wherein two or more temperature steps are conducted to reach the coalescence to for example retain the toner particle size distribution, followed by a staged changing of the pH of the aggregate mixture wherein the pH is lowered in two or more sequences to for example, provide toner process which are surfactant free .

PRIOR ART

In forming toner compositions for use with reprographic or xerographic print devices, emulsion aggregation processes are known. For example, emulsion/aggregation/coalescing processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797. Also of interest may be U.S. Pat. Nos. 5,348,832, 5,405,728, 5,366,841, 5,496,676, 5,527,658, 5,585,215, 5,650,255, 5,650,256 and 5,501,935.

In addition, the following U.S. Patents the disclosures of which are incorporated herein by reference in their entireties relate to emulsion aggregation processes for the forming of toner compositions. U.S. Pat. No. 5,922,501 describes a process for the preparation of toner comprising blending an aqueous colorant dispersion and a latex resin emulsion, and which latex resin is generated from a dimeric acrylic acid, an oligomer acrylic acid, or mixtures thereof and a monomer; heating the resulting mixture at a temperature about equal, or below about the glass transition temperature (Tg) of the latex resin to form aggregates; heating the resulting aggregates at a temperature about equal to, or above about the Tg of the latex resin to effect coalescence and fusing of the aggregates; and optionally isolating the toner product, washing, and drying.

U.S. Pat. No. 5,945,245 illustrates a surfactant free process for the preparation of toner comprising heating a mixture of an emulsion latex, a colorant, and an organic complexing agent.

U.S. Pat. No. 5,403,693 illustrates a process for the preparation of toner compositions with controlled particle size comprising: (i) preparing a pigment dispersion in water, which dispersion is comprised of a pigment, an ionic surfactant in amounts of from about 0.5 to about 10 percent by weight of water, and an optional charge control agent; (ii) shearing the pigment dispersion with a latex mixture comprised of a counterionic surfactant with a charge polarity of opposite sign to that of said ionic surfactant, a nonionic surfactant, and resin particles, thereby causing a flocculation or heterocoagulation of the formed particles of pigment, resin, and charge control agent; (iii) stirring the resulting sheared viscous mixture of (ii) at from about 300 to about 1,000 revolutions per minute to form electrostatically bound substantially stable toner size aggregates with a narrow particle size distribution; (iv) reducing the stirring speed in (iii) to from about 100 to about 600 revolutions per minute, and subsequently adding further anionic or nonionic surfactant in the range of from about 0.1 to about 10 percent by weight of water to control, prevent, or minimize further growth or enlargement of the particles in the coalescence step (iii); and (v) heating and coalescing from about 5 to about 50° C. about above the resin glass transition temperature, Tg, which resin Tg is from between about 45° C. to about 90° C. and preferably from between about 50° C. and about 80° C. the statically bound aggregated particles to form a toner composition comprised of resin, pigment and optional charge control agent.

U.S. Pat. No. 5,482,812 illustrates a process for the preparation of toner compositions or toner particles comprising: (i) providing an aqueous pigment dispersion comprised of a pigment, an ionic surfactant, and optionally a charge control agent; (ii) providing a wax dispersion comprised of wax, a dispersant comprised of nonionic surfactant, ionic surfactant or mixtures thereof; (iii) shearing a mixture of the wax dispersion and the pigment dispersion with a latex or emulsion blend comprised of resin, a counterionic surfactant with a charge polarity of opposite sign to that of said ionic surfactant and a nonionic surfactant; (iv) heating the above sheared blend below about the glass transition temperature (Tg) of the resin to form electrostatically bound toner size aggregates with a narrow particle size distribution; (v) adding additional ionic surfactant to the aggregated suspension of (iv) to ensure that no, or minimize additional particle growth of the electrostatically bound toner size aggregates occurs on further increasing the temperature to coalesce the aggregates into toner particles (vi); (vi) heating the mixture of (v) with bound aggregates above about or at the Tg of the resin; and optionally (vii) separating the toner particles from the aqueous slurry by filtration and thereafter optionally washing.

U.S. Pat. No. 5,622,806 illustrates a process for the preparation of toner compositions with controlled particle size comprising: (i) preparing a pigment dispersion in water, which dispersion is comprised of a pigment, an ionic surfactant in amounts of from about 0.5 to about 10 percent by weight to water, and an optional charge control agent; (ii) shearing the pigment dispersion with a latex mixture comprised of a counterionic surfactant with a charge polarity of opposite sign to that of said ionic surfactant, a nonionic surfactant, and resin particles, thereby causing a flocculation or heterocoagulation of the formed particles of pigment, resin, and charge control agent; (iii) stirring the resulting sheared viscous mixture of (ii) at from about 300 to about 1,000 revolutions per minute to form electrostatically bound substantially stable toiler size aggregates with a narrow particle size distribution; (iv) reducing the stirring speed in (iii) to from about 100 to about 600 revolutions per minutes, and subsequently adding further anionic or nonionic surfactant in the range of from about 0.1 to about 10 percent by weight of water to control, prevent, or minimize further growth or enlargement of the particles in the coalescence step (v); (v) heating and coalescing from about 5° C. to about 50° C. above about the resin glass transition temperature, Tg, which resin Tg is from between about 45° C. to about 90° C., the statically bound aggregated particles to form said toner composition comprised of resin, pigment and optional charge control agent; (vi) washing the aggregated particles at a temperature of from about 15° C. to about 5° C. below the glass transition temperature of the resin, and subsequently filtering the aggregated particles until substantially all of the surfactant has been removed from the aggregated particles, followed by subsequent driving of the particles at a temperature of from about 15° C. to about 5° C. below the glass transition temperature of the resin; and (vii) subsequently adding to said toner product a first layer of a hydrophilic oxide, and a second layer of a hydrophobic oxide.

SUMMARY OF THE INVENTION

It is an feature of the present invention to provide a surfactant free latex emulsion followed by the aggregation/coalescence thereof with an aqueous dispersion of colorant particles comprising submicron colorant particles which have a resin coating wherein the resin contains sulfonated polyester groups thereby providing for stabilization of the colorant particles for example, in water resulting in a colorant dispersion which is stable for over 100 days, followed by the addition of a cationic coagulant or dual coagulants during the homogenization or the blending to provide a toner composition.

It is a further feature of the present invention to provide a toner process that can be rapidly conducted for example for about 4 to 6 hours and wherein only minimum washing of the toner particles is needed, such as such as 1 to 2 washes and shorter coalescence times compared to a number of the known toner surfactant processes.

Aspects of the present invention relate to a process for the preparation of toner comprising: (i) generating by emulsion polymerization in the presence of an initiator a first resin latex emulsion; (ii) generating by polycondensation a second resin latex in the presence of a catalyst; (iib) dispersing the resin of (ii) in warm water which is in the temperature range of about 50 to about 95 degrees Centigrade and preferably in the range of about 60 to about 80 degrees Centigrade to provide a resin dispersion; (iii) mixing (iib) with a colorant thereby providing a colorant dispersion; (iiib) mixing the resin latex emulsion of (i) with the resin/colorant mixture of (iii) to provide a blend of a resin and colorant; (iv) adding an aqueous inorganic cationic coagulant solution of for example, a polymeric metal salt and optionally an organic cationic coagulant to the resin/colorant blend of (iiib); (v) heating at a temperature of from about 5 to about 10 degrees Centigrade below the resin Tg of (i), to thereby form aggregate particles and which particles are at a pH of form about 2 to about 3.5; (vi) adjusting the pH of (v) to about 6.5 to about 9 by the addition of a base; (vii) heating the aggregate particles of (v) at a temperature of from about 5 to about 50 degrees Centigrade above the Tg of the resin of (i), followed by a reduction of the pH to from about 2.5 to about 5 by the addition of an acid resulting in coalesced toner; (viii) optionally isolating the toner; a process wherein subsequent to (vi) there is added a further latex comprised of resin generated by emulsion polymerization; a process wherein subsequent to the addition of the latex there is formed a coating on the aggregates obtained in (v); a process wherein the resulting resin is dispersed in warm water to result in a resin dispersion which dispersion is then added to colorant and mixed providing a colorant dispersion; a process wherein the resin forms a coating on the colorant thereby providing a stable colorant; a process wherein (iv) is accomplished by continuous stirring while subjecting the blend to high shear to primarily form a homogeneous gel; a process wherein the toner is isolated; a process for the preparation of a toner comprising: (i) generating by emulsion polymerization in the presence of an initiator a latex emulsion containing a first resin; (ii) generating by a polycondensation reaction a second resin and wherein the resulting resin is dispersed in warm water to provide a dispersion of the second resin; (iii) mixing the resulting resin dispersion of (ii) and a colorant wherein there is formed a coating of resin (ii) on said colorant thereby providing a stable colorant dispersion wherein optionally from about 70 to about 95 percent of colorant is coated by said resin; (iv) blending the resin latex emulsion of (i) with the colorant/resin dispersion (iii), to form a resin latex/colorant blend; (v) adding an aqueous inorganic cationic coagulant solution of a metal salt and an organic cationic coagulant to the resin latex/colorant blend (iv), while continuously subjecting the blend to high shear to generate a homogeneous gel of the resin/colorant blend; (vi) heating the sheared gel of (v) at a temperature of from about 5 to about 10 degrees Centigrade below the resin (i)glass transition temperature while stirring to form aggregate particles of resin, coagulant and colorant; (vii) optionally retaining (vi) for a period of from about 1 to about 3 hours to primarily minimize growth of the aggregates and achieve a narrow GSD of from about 1.15 to about 1.24; (viii) optionally adding a further latex comprised of resin(i), wherein the addition of said latex enables the formation of a coating on said aggregates of (vii); (ix) changing the pH of the said aggregates of (vii) or optionally of (viii) which is initially in the range of from about 2 to about 3.5 to a pH to about 6.5 to about 9 by the addition of a base to thereby primarily stabilize the aggregate particles from further growth; (x) heating the aggregate particles of (ix) at temperatures of from about 5 to about 50 degrees Centigrade above the Tg of the resin (i), for an optional period of from about 0.5 to about 1 hour, followed by a reduction of the pH from about 6.5 to about 9 to a pH range of about 2.5 to about 5 with an acid to form coalesced particles of a toner composition of resin (i), resin (ii), resin (viii) and colorant; (xi) optionally separating and drying the toner; a process wherein said resin (i) is submicron in size and wherein said submicron is from about 50 to about 250 nanometers in diameter; said warm is from about 60 to about 80 degrees Centigrade; said resin of (ii) is dispersed in warm water resulting in a resin dispersion of a particle size in the range of 30 to 120 nanometers in diameter and wherein the dispersion of (ii) is selected as dispersant for the colorant particles to provide a stable colorant dispersion, by grinding the colorant particles in the resin dispersion if (ii) resulting a colorant dispersion comprising colorant particles with a resin coating in water, resulting in a colorant/resin dispersion and wherein the coating of said second resin (iii) is from about of 10 to about 120 nm in thickness, the coating thickness of said additional latex (viii) after the formation of the aggregates is in the range of from about 0.1 (100 nm) to 1 micron, in diameter; and wherein the components of the final toner are (a) resin from latex of (i), (b) resin from (ii), (c) resin from (viii), and (d) colorant, with the optional amount ranges (i) about 53.5 to about 65.6%, colorant loading about 4 to about 15%, resin from (ii) to about 0.4 to about 1.5% and resin from (viii) about 15 to about 30% and wherein the total of said toner components is about 100 percent; a process wherein the latex of (i) comprises submicron resin of styrene-butylacrylate-sulfopropylmethacrylate which sulfonate optionally functions act as a dispersant for said sub micron resin particles thereby providing a stable latex; a process wherein the pH during the blending and the aggregation (iv) to (viii) is in the range of about 1.8 to 4.5; a process wherein an acidic pH range of from about 1.8 to 4 enables a narrow particle size distribution of said toner aggregates of (vi), wherein the size distribution thereof is in the range of from about 1.16 to about 1.24; wherein the latex (vii) is comprised of the same polymer resin composition as that of (i) or a different polymer composition and/or different molecular properties such as molecular weight, molecular number and the molecular weight distribution and the Tg than that of (i), thereby providing a core shell structure on the toner particles; a process wherein the second resin (ii) prepared by solution polymerization provides a resin which is dispersable in warm water wherein the temperature of said water is in the range of form about 60 to about 80 degrees Centigrade thereby providing a stable emulsion containing submicron size resin particles which are in the size range diameter of from about 0.03 to about 0.12 micronsin water; a process wherein the inorganic cationic coagulant is selected from the group consisting of metal complexes of sulfates, chlorides or nitrates; a process in accordance with claim 8 wherein said coagulant is poly aluminutesum sulfosulfate, poly aluminum chloride, iron oxy chloride or poly aluminutesum sulfate; a process wherein the organic cationic coagulant is an organic salt of dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylaminuteses, or dodecylbenzyl triethyl ammonium chloride; a process further optionally including adding a wax dispersion, comprised of submicron wax particles in the size range of about 80 to about 200 nm, which are stabilized by the resin of (ii), and wherein the wax particles contain a coating of the resin of (ii); a process wherein the wax is selected from the group consisting of polyethylene, polypropylene, polyethylene/amide, polyethylenetetrafluoroethylene, and polyethylenetrtraflouorethylene/amide; a process wherein the wax comprised of submicron wax particles in the size range of about 80 to about 200 nm; a process wherein the second resin prepared by polycondensation in the presence of a catalyst is selected from a group consisting of poly(1,2-propylene-sodio 5-sulfoisophthalate), poly(neopentylene-sodio 5-sulfoisophthalate), poly(diethylene-sodio 5-sulfoisophthalate), copoly-(1,2-propylene-sodio 5-sulfoisophthalate)-copoly-(1,2-propylene-terephthalate phthalate), copoly-(1,2-propylene-diethylene-sodio 5-sulfoisophthalate)-copoly-(1,2-propylene-diethylene-terephthalate-phthalate), copoly-(ethylene-neopentylene-sodio 5-sulfoisophthalate)-copoly-(ethylene-neopentylene-terephthalate-phthalate), copoly-(propoxylated bisphenol A)-copoly-(propoxylated bisphenol A-sodio 5-sulfoisophthalate) and wherein the latex resin of (i) is selected from a group consisting of poly(styrene-acrylate), poly(styrene-butadiene), poly(para-methyl styrene-butadiene), poly(meta-methyl styrene-butadiene), poly (alpha-methylstyrene-butadiene), poly(methylmethacrylate-butadiene), poly(ethylmethacrylate-butadiene), poly (propylmethacrylate-butadiene), poly(butylmethacrylate-butadiene), poly(methylacrylate-butadiene), poly (ethylacrylate-butadiene), poly(propylacrylate-butadiene), poly(butylacrylate-butadiene), poly(styrene-isoprene), poly (para-methyl styrene-isoprene), poly(meta-methyl styrene-isoprene), poly(alpha-methylstyrene-isoprene), poly (methylmethacrylate-isoprene), poly(ethylmethacrylate-isoprene), poly(propylmethacrylate-isoprene), poly (butylmethacrylate-isoprene), poly(methylacrylate-isoprene), poly(ethylacrylate-isoprene), poly (propylacrylate-isoprene), and poly(butylacrylate-isoprene) copolymers; a process wherein the polycondensation catalyst is selected from a group of tetraalkyl titinates, diaalkyltin oxide, tetraalkyltin oxide hydroxide, dialkyltin oxide hydroxide, aluminum alkoxides, alkylzinc, dialkyl zinc, zine oxides, stannous oxide, dibutyltin oxide, dibutyltin oxide hydroxide, tetraalkyl tin in amounts of from about 0.01 mole percent to about 2.0 moll percent of the resin; a process wherein the heating in (vi) is at a temperature of from 5° C. to 10° C. below the glass transition temperature (Tg) of the latex emulsion resin of (i) and the stirring is at speeds of between about 200 and about 800 rpm to form aggregates of a diameter of from about 3 to about 10 microns with a narrow GSD in the range of from about 1.10 to about 1.25, wherein the heating in (x) is conducted at a temperature of from about 5° C. to about 50° C. above the glass transition temperature (Tg) of the resin of (i) to form toner particles are comprised of styrene-butylacrylate-sulfopropylmethacrylate, sodio sulfonated polyester and a colorant; a process wherein the latex resin dispersion of (i) contains submicron resin particles having an average size diameter of 250 nm or less and preferably wherein the size is in the range of 180 to 290 nm, wherein the high shear in (v) is from 3,000 to 10,0000 rpm for 1 to about 120 minutes; and wherein the toner particles obtained have an average volume diameter of from about 3 to about 10 microns and a particle size distribution of 1.10 to 1.25; a process wherein the water soluble initiator for the preparation of the latex is ammonium persulfate, potassium persulfate, sodium persulfate, ammonium persulfite, potassium persulfite, sodium persulfite, ammonium bisulfate, potassium bisulfate, sodium bisulfate, 1,1'-azobis (I-methybutyronitrile-3-sodium sulfonate, and 4,4'-azobis (4cyanovaleric), and is selected in the amount of about 0.1 to about 10 weight percent of the monomer to be polymerized; a wherein the water is warm and is at a temperature of from about 50 to about 95 degrees Centigrade; a process wherein warm is at a temperature from about 60 to about 80 degrees Centigrade and wherein said resin forms a coating on the colorant thereby providing a stable colorant; a process for the preparation of toner comprising (i) generating by emulsion polymerization in the presence of an initiator a first resin latex emulsion; (ii) generating by polycondensation a second resin latex in the presence of a catalyst; (iib) dispersing the resin of (ii) in warm water which is in the range of about 50 to about 95 degrees Centigrade and preferably in the range of 60 to 80 degrees Centigrade to provide a resin dispersion; (iii) mixing (iib) with a colorant thereby providing a colorant dispersion; (iiib) mixing the resin latex emulsion of (i) with the resin/colorant mixture of (iii) to provide a blend of a resin and colorant; (iv) adding an aqueous inorganic cationic coagulant solution of a polymeric metal salt and optionally an organic cationic coagulant to the resin/colorant blend of (iiib); (v) heating at a temperature of from about 5 to about 10 degrees Centigrade below the resin Tg of (i), to thereby form aggregate particles and which particles are at a pH of form about 2 to about 3.5; (vi) adjusting the pH of (v) to about 6.5 to about 9 by the addition of a base; (vii) heating the aggregate particles of (v) at a temperature of from about 5 to about 50 degrees Centigrade above the Tg of the resin of (i), followed by a reduction of the pH to from about 2.5 to about 5 by the addition of an acid resulting in coalesced toner; (viii) optionally isolating the toner; a process for the preparation of a toner composition comprising (i) forming a first resin latex emulsion of a submicron resin particles in the absence of an ionic or a nonionic surfactant by an emulsion polymerization; (ii) preparing a second resin wherein the resin is then dispersable in warm water to provide a submicron resin dispersion, or a self dispersing resin; (iii) and wherein the dispersion of (ii) is then selected as a colorant dispersant thereby providing a coating or a shell or the colorant by using grinding mills to provide a stable colorant dispersion; (iv) blending the resin latex emulsion of (i) with the colorant dispersion of (iii), to form a resin-colorant blend; (v) adding an aqueous coagulant solution to the resin-colorant blend, while continuously subjecting the blend to high shear, to induce a homogeneous mixture of a resin-colorant blend; (vi) heating the resulting sheared gel at temperature below the resin glass transition temperature (Tg) while continuously stirring to form aggregates particles; (vii) following a period about 1 to 2.5 hours of aggregation time to permit stabilization of the aggregate particles size; (viii) optionally adding the resin latex emulsion of (i) to the mixture of the aggregate particles (ix); changing the pH of the mixture from 2.6 to about 7 or more and preferably to about 6.5 to about 8.5 with a base to stabilize the aggregates wherein the increase in the pH assists in retaining the aggregate particle size and the particle size distribution; (x) heating the aggregate particles at temperatures above the Tg of the resin, followed by a reduction of the pH of from about 8 to about 2.5 to 5.5 and preferably to about 3 to about 5 with an acid to form coalesced particles of a toner composition with a smooth surface, almost spherical in morphology wherein the advantages of such particles are in their clean ability during development, less additives usage during dry blending, stable charge over a period of time in the developer housing, and better mechanical integrity of the particles in the developer housing; (xi) followed by separating the particles by either filtration, centrifugation or other means and drying the particles by for example, freeze drying, fluid bed drying or spray drying; (i) forming a resin latex emulsion of submicron resin particles in the absence of an ionic or a nonionic surfactant by an emulsion polymerization; (ii) preparing a second resin by condensation polymerization, wherein the resulting resin is then dispersed in water to provide a sub micron resin dispersion; (iii) the dispersion of (ii) is then utilized to stabilize the colorant particles; (iv) blending the resin latex emulsion of (i) with the colorant dispersion of (iii), to form a resin-colorant blend; (v) adding an aqueous inorganic cationic coagulant solution of a poly metal salt and optionally an organic cationic coagulant to the resin-colorant pigment blend, while continuously subjecting the blend to a high shear to primarily induce a homogeneous gel of the resin-colorant blend; (vi) heating the sheared gel at temperature of 5 to 10 degrees Centigrade below the resin glass transition temperature (Tg) while continuously stirring to form aggregate particles; (vii) following a period of aggregation time to permit stabilization of the aggregate particle size; (viii) optionally adding the above latex emulsion (i) to provide a structure coated colorant; (ix) changing the pH of the mixture initially 2 to 3 to 7 to 10 and preferably to about 6.5 to about 9 with a base to stabilize the aggregate particles; (x) heating the aggregate particles at a temperature of 5 to 60 degrees Centigrade above the Tg of the resin, followed by a reduction of the pH to about 2.5 to 5.5 and preferably to 3 to 5 with an acid to form coalesced particles of a toner composition with a smooth surface; (xi) followed by separating the toner particles by for example, filtration, centrifugation or other means and drying the toner by for example, freeze drying, fluid bed drying or spray drying; (i) forming a resin latex emulsion of a submicron resin particles in the absence of surfactants and by an emulsion polymerization, wherein the monomers utilized are polymerizable in the presence of a water soluble initiator; (ii) preparing a second resin latex by a polycondensation polymerization to generate a polymeric resin comprised for example, of a sodio sulfonated polyester and which (ii) is accomplished in the presence of an organo metal catalyst, such as butyltin oxide wherein the resin obtained is then dispersed in warm water to provide a submicron resin dispersion; (iii) wherein the dispersion of (ii) is then utilized to stabilize the colorant particles; (iv) blending the resin latex dispersion with the colorant dispersion and optionally a wax dispersion, to form a resin-colorant blend; (v) adding a mixture of an inorganic coagulant solution of a polymeric metal salt such as poly aluminum chloride (PAC) dissolved in dilute nitric acid and an organic cationic coagulant such as dialkyl benzenealkyl ammonium chloride or mixtures thereof to the resin-colorant blend, while continuously subjecting the blend to high shear to induce a homogeneous gel of the resin-pigment blend; (vi) heating the sheared gel at a temperature of about 5 to about 10 degrees Centigrade below the resin glass transition temperature (Tg) to form aggregates particles; (viii) optionally adding to the above latex of (i) a latex with a dissimilar resin that the resin of (I); changing the pH of the mixture from 2 to 3 to greater than 6 and preferably to about 6.5 to about 9.5 with a base to stabilize the aggregate particles; (x) heating the aggregate particles at a temperature of 5 to 60 degrees Centigrade above the Tg of the resin, followed by a reduction of the pH to about 2.5 to 5.5 and preferably to 3 to 5 with an acid to form coalesced particles of a toner composition with a smooth surface; (xi) followed by separating the toner particles and drying the toner particles; optionally adding toner additives such as waxes process and charge control agents, during the blending (iv), wherein the release agents such as wax and the charge control agents particles are stabilized with the resin dispersion of (ii); examples of waxes being illustrated U.S. Pat. No. 5,994,020 the disclosure of which is totally incorporated here by reference.

Illustrative examples of latex resin particles (i) are selected for example, from known polymers selected from the group consisting of for example, poly(styrene-butylacrylate), poly(styrene-butadiene), poly(para-methyl styrenebutadiene), poly(meta-methyl styrene-butadiene), poly(alpha-methyl styrene-butadiene), poly (methylmethacrylate-butadiene), poly(ethylmethacrylate-butadiene), poly(propylmethacrylate-butadiene), poly (butylmethacrylate-butadiene), poly(methylacrylate-butadiene), poly(ethylacrylate-butadiene), poly (propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly (propylmethacrylate-isoprene), poly(butylmethacrylate-isoprene), poly(methylacrylate-isoprene), poly (ethylacrylate-isoprene), poly(propylacrylate-isoprene), and poly(butylacrylate-isoprene); and terpolymers such as poly (styrene-butadiene-acrylic acid), poly(styrene-butadiene-methacrylic acid), PLIOTONE available from Goodyear, polyethylene-terephthalate, polypropylene-terephthalate, polybutylene-terephthalate, polypentylene-terephthalate, polyhexalene-terephthalate, polyheptadene-terephthalate, polyoctalene-terephthalate, all containing sodium styrene sulfonate, POLYLITE (Reichhold Chemical Inc.), PLASTHALL (Rohm & Haas), CYGAL (American Cyanamide), ARMCO (Armco Composites), ARPOL (Ashland Chemical), CELANEX (Celanese Eng.), RYNITE (DuPont), and STYPOL, and the like.

The latex resin particles of (i) selected for the process of the present invention are preferably prepared by for example, emulsion polymerization techniques, including semi-continuous emulsion polymerization methods, and the monomers utilized in such processes can be selected from, for example, styrene, acrylates, methacrylate, butadiene, isoprene, in the presence of sulfonatedpropylmethacrylate and optionally acid or basic olefinic monomers such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride and the like. The presence of acid or basic groups in the monomer, or polymer resin is optional and such groups can be present in various amounts such as of from about 0.1 to about 10 percent by weight of the polymer resin. Chain transfer agents for example, in amounts of from about 0.1 to about 12 weight percent such as dodecanethiol or carbon tetrabromide, can also be selected when preparing the resin particles by emulsion polymerization.

The second resin such as sodio sulfonated polyester dissipates in embodiments, easily in warm water to provide an emulsion. Illustrative examples of second resins are a sodio sulfonated polyester, and more specifically a polyester, such as poly(1,2-propylene-sodio 5-sulfoisophthalate), poly (neopentylene-sodio 5-sulfoisophthalate), poly(diethylene-sodio 5-sulfoisophthalate), copoly-(1,2-propylene-sodio 5-sulfoisophthalate)-copoly-(1,2-propylene-terephthalate phthalate), copoly-(1,2-propylene-diethylene-sodio 5-sulfoisophthalate)-copoly-(1,2-propylene-diethylene-terephthalate-phthalate), copoly-(ethylene-neopentylene-sodio 5-sulfoisophthalate)-copoly-(ethylene-neopentylene-terephthalate-phthalate), copoly-(propoxylated bisphenol A)-copoly-(propoxylated bisphenol A-sodio 5-sulfoisophthalate), and the like. Other example of water soluble polymers are styrene acrylics wherein the polymer contains greater than for example about 10 to 35 percent of an acrylic acid monomer which can render the polymers soluble in water. Polymers with functionalized end groups such as amines are also water soluble and can be selected.

Examples of waxes that can be selected are polyethylene, polypropylene functionalized waxes, such as amines, amides for example aqua superslip 6550, Superslip 6530, wherein more specifically the functionalized wax is a polyethylene/amide available from Micro powder Inc, fluorinated waxes for examples polyfluo 190, Polyflo 200, Polyfluo 523XF, Aqua Polyfluo 411—all polyethylene/PTFE functionalized waxes, Aqua Polysilk 19, Polysilk 14,—all polethylene/PTFE/amide functionalized waxes available from Micro Powders INC, Mixed Fluroniated, amide wax for example, microspersion 19 also available from Micro powder Inc, imides, esters, quaternary a minute, carboxylic acids or acrylic polymer emulsions for example, Joncryl 74, 89, 130, all available from Johnson & son, chlorinated polypropylenes and polyethylenes. The amount of wax that is added is in the range of about 2 to about 15 percent by weight of toner, and which wax can be added during the blending of the latex and the colorant, wherein the wax is usually added in the form of a dispersion of submicron wax particles suspended in an aqueous media.

The latex resin particles of (i) are present in various effective amounts, such as from about 70 weight percent to about 98 weight and preferably between about 80 and about 92 percent of the toner, and can be of small average particle size such as from about 0.01 micron to about 1 micron in average volume diameter as measured by the Brookhaven nanosize particle analyzer. Other effective amounts of resin can be selected.

Suitable water soluble initiators include but are not limited to, ammonium persulfate, potassiun persulfate, sodium persulfate, ammonium persulfite, potassium persulfite, sodium persulfite, ammonium bisulfate, potassium bisulfate, sodium bisulfate, 1,1'-azobis(I-methybutyronitrile-3-sodium sulfonate, and 4,4'-azobis(4 cyanovaleric acid. Preferably the initiator is a persulfate initiator such as ammonium persulfate, potassium persulfate, sodium persulfate and the like. The initiator is generally added as part of an initiator solution in water. The amount of initiator used to form the latex polymer is generally for example, from about 0.1 to 10 weight percent of the monomer to be polymerized.

Specific examples of polycondensation catalysts include tetraalkyl titinates, diaalkyltin oxide, tetraalkyltin oxide hydroxide, dialkyltin oxide hydroxide, aluminum alkoxides, alkylzinc, dialkyl zinc, zine oxides, stannous oxide, dibutyltin oxide, dibutyltin oxide hydroxide, tetraalkyl tin such as dibutyltin dilaurate, mixture thereof and the like selected in effective amounts of from for example, about 0.01 mole percent to about 3 mole percent or weight percent resin.

The second resin (ii) can be prepared by a polycondensation process, followed by preferably dispersing the resin in water to provide a resin dispersion. Other processes of obtaining resin dispersion particles of from about 0.01 micron to about 1 micron can be selected from polymer microsuspension process, such as illustrated in U.S. Pat. No. 3,674,736, the disclosure of which is totally incorporated herein by reference, polymer microsuspension process, such as disclosed in U.S. Pat. No. 5,290,654, the disclosure of which is totally incorporated herein by reference, mechanical grinding process, and other known processes.

Specific examples of sulfonated polyester resins of (ii) are poly(1,2-propylene-sodio 5-sulfoisophthalate), poly (neopentylene-sodio 5-sulfoisophthalate), poly(diethylene-sodio 5-sulfoisophthalate), copoly-(1,2-propylene-sodio 5-sulfoisophthalate)-copoly-(1,2-propylene-terephthalate phthalate), copoly-(1,2-propylene-diethylene-sodio 5-sulfoisophthalate)-copoly-(1,2-propylene-diethylene-terephthalate-phthalate), copoly-(ethylene-neopentylene-sodio 5-sulfoisophthalate)-copoly-(ethylene-neopentylene-terephthalate-phthalate), copoly-(propoxylated bisphenol A)-copoly-(propoxylated bisphenol A-sodio 5-sulfoisophthalate), and the like. The solids content of the resin latex dispersion (ii) comprises for example, of sodio-sulfonated polyester may vary from, for example, about 10 to about 60% and from about 90 to about 40% water.

The colorant, such as the pigment dispersion is not particularly limited in composition or method of preparation. The colorant dispersion preferably comprises submicron colorant particles in the diameter size range of about 0.08 to about 0.2 microns which are stabilized by for example, submicron resin particle of a sodio sulfonated polyester resin in the size range of about 0.05 to about 0.15 microns. Other polymeric resins that can be employed are those having functionalized groups such as carboxylic acids, sulfonates, and phosphates which allow them to be dispersed in water in either acidic or basic conditions.

In some instances, colorants are available in the wet cake or concentrated form containing water, and can be easily dispersed utilizing a homogenizer or simply by stirring. Pigments are available in a dry form, whereby dispersion in water is effected by microfluidizing using, for example, a M-110 microfluidizer or an ultimizer and passing the pigment dispersion from 1 to 10 times through the chamber, or by sonication, such as using a Branson 700 sonicator, or a homogenizer with addition of dispersing agents such as the aforementioned resin emulsion particles of sodio sulfonated polyester and other water soluble polymers. The dispersion equipment is not limited to be used to only with dry pigments, but also with wet cakes or concentrated form of pigment. Other methods of preparing colorant dispersions can optionally include melt mixing or flushing of the colorant with the resin followed by dispersing in warm water to provide a stable sub micron pigment dispersion.

Various known colorants present in the toner in an effective amount of, for example, from about 1 to about 25 percent by weight of the toner, and preferably in an amount of from about 1 to about 15 weight percent, that can be selected include known cyan, magenta, yellow, red, green, and blue pigments. Specific examples of pigments include phthalocyanine HELIOGEN BLUE L6900, D6840, D7080, D7020, PYLAM OIL BLUE, PYLAM OIL YELLOW, PIGMENT BLUE 1, available from Paul Uhlich & Company, Inc Pigment Blue 15.3, Pigment Red 81.3, Pigment 122, Pigment Red 238, Pigment Yellow 14, Pigment Yellow 17, Pigment Yellow 74, Pigment Green 7, Pigment Orange 16 available from Sun Chemicals PIGMENT VIOLET 1, PIGMENT RED 48, LEMON CHROME YELLOW DCC 1026, E.D. TOLUIDINE RED and BON RED C available from Dominutesion Color Corporation, Ltd., Toronto, Ontario, NOVAperm YELLOW FGL, HOSTAPERM PINK E, Pigment Yellow 180 from Clariant, and CINQUASIA MAGENTA available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl ammonium sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. The colorant including dyes, mixtures of dyes and pigments, mixtures of dyes, mixtures of pigments selected are present in various effective amounts, such as from about 1 weight percent to about 65 weight and preferably from about 2 to about 12 percent of the toner.

The selected coagulants may be comprised of organic intities, inorganic entities or mixtures thereof with an opposite polarity to the ionic charge of the resin latex dispersion. For example, in embodiments of the present invention, the ionic charge of the resin latex dispersion is anionic in nature due the water soluble initiator such as a persulfate and thus the counterionic coagulant is a an inorganic cationic coagulant of a metal salt such as aluminum sulfate and optionally an organic cationic coagulant such as dialkyl benzeneaklyl ammonium chloride. However, the cationic charge may be in the latex and the anionic species may then serve as the coagulant.

Examples of the organic cationic coagulants include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylaminuteses, dodecylbenzyl triethyl ammonium chloride, and the like, and mixtures thereof. The coagulant is most preferably in an aqueous medium in an amount of from, for example, about 0.05 to about 10% by weight and preferably in the range of from about 0.075 to about 5 by weight of toner.

Inorganic cationic coagulants include, for example, polyaluminum chloride (PAC), Poly aluminum sulfosilicate (PASS) and the like. The coagulant is most preferably in an aqueous medium in an amount of from, for example, about 0.05 to about 10% by weight and preferably in the range of about 0.075 to about 2% by weight. The coagulant may also contain amines or other components, for example nitric acid.

The coagulant may comprise a mixture of an inorganic and an organic coagulant including for example PAC and dialkyl benzenealkyl ammonium chloride, PASS and dialkyl benzenealkyl ammonium chloride, which mixtures of coagulants are also preferably contained in an aqueous medium, and wherein each coagulant present in an amount of from for example, about 0.05% to about 2% by weight.

The cationic coagulant is utilized in various effective amounts, such as for example from about 0.1 to about 10 percent and preferably between about 0.1 and 5 percent by weight of water. Preferably, the molar ratio of the cationic surfactant used for coagulation is related to the total amount of anionic surfactant used in the preparation of the resin latex dispersion and is in a range of, 0.5 to 4, preferably from about 0.5 to about 2.

The coagulant is preferably added slowly over a period of about 0.5 to about 30 minutes and preferably over a period of about 1 to about 10 minutes into the blend while continuously subjecting the blend to high shear, for example by stirring with a blade at about 3,000 to 10,000 rpm, or from about 5,000 rpm, for about 1 to about 120 minutes. A high shearing device, for example an intense homogenization device such as the in-line IKA SD-41, may be used to ensure that the blend is homogeneous and uniformly dispersed. This high shear effects homogenization of the resin-pigment blend or composition.

Following homogenization, aggregation of the homogenized composition is effected by heating the composition to a temperature below the glass transition temperature (Tg) of the resin of the latex while agitating the composition. The temperature of the heating is from for example, 5° C. to 10° C. below the Tg of the resin. The agitation preferably comprises continuously stirring the mixture using a mechanical stirrer at between, for example, about 200 to about 800 rpm.

The aggregation can be conducted for a period of time until the aggregate particles size is stabilized, which may be for from, for example, about 10 minutes to about 6 hours. Additional coagulants, such as organic cationics such as dialkyl benzeneaklyl ammonium chloride coagulant may be optionally added if the particle size distribution is greater than 1.25 and the fines content greater than 3 percent. Optionally adding further latex to the aggregates after (vii) can be accomplished wherein the latex is adsorbed to the aggregate surface to followed by allowing the aggregates to stabilize in particle size over a period for example 30 minutes to 60 minutes.

The particles are then preferably coalesced by first changing the pH of the aggregate composition from a pH of 2.5 to a pH of greater than 5.5, preferably to about 6 to about 8, with the addition of a base to stabilize the aggregates from further growth, followed by heating at a temperature above the Tg of the resin. Preferably about the heating for coalescing is conducted at a temperature of from 5° C. to 40° C., preferably about b10° C. to 30° C., above the Tg of the resin for about 30 minutes to 5 hours. Preferably prior to the coalescence the pH of the aggregate composition which is for example in the range of 2 to 3 is changed to a pH range of for example, 6 to 8 with any suitable pH increasing agent, such as for example sodium hydroxide. The increase in the pH stabilizes for example, the aggregates particles and prevents any further particle size growth and minimizes broad particle size distribution during further heat up for example raising the temperature 5 to 40 degrees Centigrade above the resin Tg. After about 15 to 60 minutes at the coalescence temperature, the pH can be gradually decreased back in the range of about 3 to about 5, wherein the reduction in pH permits the colaescence or fusion. The preferred pH reducing agents include for example nitric acid, citric acid, sulfuric acid or hydrochloric acid, and the like. In embodiments of the present invention the blending and aggregation are performed in the pH range of about 1.8 to about 3 and preferably in the range of about 2 to about 2.8, while the colaescence is initially conducted in the pH range of about 6.5 to about 8.0 followed by a reduction in pH to a range of about 3 to about 5 to induce complete coalescence.

Following addition of the coagulant, coagulants or additional latex in addition to latex (i), the delayed latex can then be added to form the remaining shell on the colorant or the toner. The pH changes and the coalesced toner particles obtained may optionally be separated and dried by processes known in the art and as indicated herein. The particles may also be washed with, for example, hot water to remove salts, and dried such as by use of an Aeromatic fluid bed dryer.

There can be added to the toners obtained e known charge additives in effective amounts of, for example, from 0.1 to 5 weight percent such as alkyl pyridinium halides, bisulfates, the charge control additives of U.S. Pat. Nos. 3,944,493, 4,007,293, 4,079,014, 4,394,430 and 4,560,635, the disclosures of which are totally incorporated herein by reference, and the like. Surface additives that can be added to the toner compositions after for example, washing or drying include, for example, metal salts, metal salts of fatty acids, colloidal silicas, metal oxides, mixtures thereof and the like, which additives are usually present in an amount of from about 0.1 to about 2 weight percent, reference U.S. Pat. Nos. 3,590,000, 3,720,617, 3,655,374 and 3,983,045, the disclosures of which are totally incorporated herein by reference. Preferred additives include zinc stearate and AEROSIL R972.R available from Degussa in amounts of from 0.1 to 2 percent which can be added during the aggregation process or blended into the formed toner product.

Developer compositions can be prepared by mixing the toners obtained with the process of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

With the process of the invention toner particles of acceptable size and narrow dispersity are obtained in a rapid manner. The toner particles preferably have an average volume diameter of from about 0.5 to about 25, and preferably from 1 to about 10 microns, and a narrow GSD characteristic of from about 1.05 to about 1.25, and preferably of from 1.15 to 1.25 as measured by a Coulter Counter. The toner particles also have an excellent shape factor, for example of 120 or less wherein the shape factor refers to the smoothness and roundness, as determined with a microscope where a shape factor of 100 is considered perfectly spherical and smooth, while a shape factor of 140 is considered to be rough in surface morphology and the shape is like a potato. The resulting toners can be selected for known electrophotographic imaging and printing processes, including color processes, digital imaging processes and systems, and lithography.

The following Examples are provided. Parts and percentages are by weight unless otherwise indicated.

EXAMPLES

Latex Formation Procedure; No Acrylic Acid

Latex Preparation:

Surfactant Free Latex Containing No Acid-(Latex A):

A latex was generated with a 20 weight percent monomer loading and a weight ratio of 70/30 wt % (weight percent) St/BA (styrene/butylacrylate) with no acid functionality monomer. The latex preparation was performed in the following manner. The organic phase comprised of 192.5 grams of styrene, 82.5 grams of butyl acrylate to which 2.75 grams (1 weight percent by weight of monomer) of dodecanethiol-DDT (a chain transfer agent) was mixed. Separately an aqueous phase comprised of 1,100 grams of deionized water to which 2.8 grams of ammonium persulfate (initiator) and 8.25 grams of sulfonatedpropylmethacrylate was added was mixed. The aqueous phase was then charged into a 2 L buchi reactor, and the organic phase was then added to the acgueos phase at about 25 degrees Centigrade under a nitrogen blanket to generate the emulsified phase. The temperature of the emulsified phase was then increased to 70 degrees Centigrade (degrees Centigrade) and held there for a period of 6 hours to conduct the emulsion polymerization. The reactor was then cooled down to room temperature at about 25 degress Centigrade and the physical properties of the latex were measured. The resin latex particle size was 170 nm, with a Mw of 31,000 and a Tg of 54 degrees Centigrade.

Surfactant Free Latex Containing Methacrylic Acid (Latex B):

A latex was generated with 20 weight percent monomer loading, weight ratio of 70/30 wt % St/BA and 5 pph of methacrylic acid (MAA). The latex preparation was performed in the following manner. The organic phase comprised of 192.5 grams of styrene, 82.5 grams of butyl acrylate, 13.75 grams of MAA to which 3.4 grams (1.24 weight percent by weight of monomer) of dodecanethiol-DDT (a chain transfer agent) was added and was mixed. Separately an aqueous phase comprised of 1,100 grams of deionized water to which 2.8 grams of ammonium persulfate (initiator) and 8.25 grams of sulfonatedpropylmethacrylate was added while mixing. The aqueous phase was then charged into a 2 L buchi reactor, and the organic phase was then added to the aqueous phase and stirred at 200 rpm for a period of 30 minutes at room temperature under a nitrogen blanket to generate the emulsified phase. The temperature of the emulsified phase was then raised to 70 degrees Centigrade and held there for a period of 6 hours to conduct the emulsion polymerization. The reactor was then cooled down to room temperature and the product properties measured. The particle size of the resin latex as measured on a disc centrifuge was found to be 180 nm, with a Mw of 25 K (25,000) and a Tg of 51 degrees Centigrade.

Preparation of Linear Moderately Sulfonated Polyester B:(DF210)

A linear sulfonated random copolyester resin comprised of on a mol percent basis , approximately 0.465 of terephthalate, 0.035 of sodium sulfoisophthalate, 0.475 of 1,2-propanediol, and 0.025 of diethylene glycol was prepared as follows. In a one liter Parr reactor equipped with a bottom drain valve, double turbine agitator, and distillation receiver with a cold water condenser were charged 388 grams of dimethylterephthalate, 44.55 grams of sodium dimethylsulfoisophthalate, 310.94 grams of 1,2-propanediol (1 mole excess of glycols), 22.36 grams of diethylene glycol (1 mole excess of glycols), and 0.8 gram of butyltin hydroxide oxide as the catalyst. The reactor was then heated to 165° C. with stirring for 3 hours whereby 115 grams of distillate were collected in the distillation receiver, and which distillate was comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced from atmospheric pressure to about 260 Torr over a one hour period, and then reduced to 5 Torr over a two hour period with the collection of approximately 122 grams of distillate in the distillation receiver, and which distillate was comprised of approximately 97 percent by volume of 1,2-propanediol and 3 percent by volume of methanol as measured by the ABBE refractometer. The pressure was then further reduced to about 1 Torr over a 30 minute period whereby an additional 16 grams of 1,2-propanediol were collected. The reactor was then purged with nitrogen to atmospheric pressure, and the polymer discharged through the bottom drain onto a container cooled with dry ice to yield 460 grams of the 3.5 mol percent sulfonated-polyester resin, copoly(1,2-propylene-diethylene)terephthalate-copoly (sodium sulfoisophthalate dicarboxylate). The sulfonated-polyester resin glass transition temperature was measured to be 59.5° C. (onset) utilizing the 910 Differential Scanning Calorimeter available from E.l. DuPont operating at a heating rate of 10° C. per minute. The number average molecular weight was measured to be 3,250 grams per mole, and the weight average molecular weight was measured to be 5,290 grams per mole using tetrahydrofuran as the solvent.

Preparation of Pigment Dispersion:

30 grams of the above sulfonated polyester resin was slowly added to 270 grams of water while continuously being stirred until the resin was fully dispersed resulting in a blue tinge dispersion. The mean particle size was 57 nm as measured by the Nicomp Particle analyzer. 90 grams of PB 15.3 pigment was then added and the mixture resulting was ground in a media mill until the pigment was broken down into submicron particles. The pigment dispersion prepared was comprised of 30 percent pigment, 10 percent resin and 60 percent water. The dispersion obtained was stable.

Other Pigment Dispersion Preparations:

Similarly other pigment dispersions like PR 81.3 and Yellow 14 were prepared by repeating the above processes.

Wax Dispersion Preparation:

The dispersion equipment was comprised of a pressure reactor having a re-circulating line feeding through a microflidizer. 300 grams of a polyethylene –P 725 wax (melting point=98 degrees Centigrade) and 700 grams of a sulfonated polyester dispersion comprising 10% solids prepared as indicated above was charged into the reactor. The reactor was sealed and heated up to 110 degrees Centigrade while stirring. The recirculating lines were also heated. The reactor valves are then opened and the melted wax is subjected to high shear through the microflidizer. After a number of passes the reactor is cooled down while the reactor contents are still subjected to microfludization. A stable wax dispersion of a particles, about 0.01 microns diameter size stabilized by sulfonated polyester resin was obtained.

Toner Preparation:

Example 1: Cyan Toner

To 310 grams of the above latex (A), comprising styrene/butylacrylate/sulfopropylmethacrylate submicron resin particles suspended in an aqueous media there was simultaneously added 100 grams of a dilute pigment dispersion comprising 20 grams of Blue 15.3 pigment stabilized by sulfonated polyester submicron particles (30% pigment and 10% sulfonated polyester) and 80 gm (grams) of water to 400 grams of water, while being polytroned at high speeds, (about 5,000 RPM) 2.0 grams of the inorganic cationic coagulant poly aluminum chloride (10% solids in nitric acid) with 6.0 grams of aqueous nitric acid of pH=2, was added to the above mixture. 2.0 grams of the cationic organic coagulant dialkyl benzenealkyl ammonium chloride in 10 grams of water was then added and the mixture resulting was polytroned for a period of 2 minutes at a speed of 5,000 rpm. The mixture was then transferred into a reaction kettle and heated to 47 degrees Centigrade for a period of 120 minutes where the particle size as measured on a Coulter Counter was 5.9 microns with a GSD of 1.20. The pH of the slurry was then adjusted from 2.7 to 8 with the addition of a 4% aqueous NaOH solution. The temperature of the reaction kettle was then raised to 75 degrees Centigrade and held there for 15 minutes. The particle size measured was 5.9 microns with a GSD of 1.22. The temperature of the reactor was then further raised to 85 degrees Centigrade and held there for 30 minutes resulting in a particle size of 6 microns and a GSD of 1.23. The pH of the reaction mixture was then slowly reduced down to 4.5 with 1.0% dilute nitric acid. An additional 60 minutes at 85 degrees Centigrade and cooling resulted in smooth toner particles and the toner shape factor was considered to be 121. The toner particle size after cooling the reactor contents was found to be 6 microns in average volume diameter with a GSD of 1.21.

Example 2: Cyan Toner

To 310 grams of the above latex (B), comprising styrene/butylacrylate/sulfopropylmethacrylate submicron resin particles suspended in an aqueous media was simultaneously added 100 grams of a dilute pigment dispersion comprising 20 grams of Blue 15.3 pigment stabilized by sulfonated polyester submicron particles (30% pigment and 10% sulfonated polyester) and 80 gm (grams) of water, to 400 grams of water, while being polytroned at high speeds. About 2 grams of the inorganic cationic coagulant poly aluminum chloride (10% solids in nitric acid) with 6.0 grams of aqueous nitric acid of pH=2, was added to the above mixture. 2.0 grams of cationic organic coagulant dialkyl benzenealkyl ammonium chloride in 10 grams of water was then added and polytroned for a period of 2 minutes at speeds of 5,000 rpm. The mixture was then transferred to a reaction kettle and heated to 50 degrees Centigrade for a period of 120 minutes where the particle size as measured on a Coulter Counter was 5.5 microns with a GSD of 1.19. The pH of the slurry was then adjusted from 2.7 to 8.0 by the addition of 4% aqueous NaOH solution. The temperature of the reaction kettle was raised to 75 degrees Centigrade and held there for 30 minutes. The measured particle size was 5.7 microns with a GSD of 1.19. The temperature of the reactor was the further raised to 85 degrees and held there for 30 minutes resulting in a particle size of 5.6 microns and a GSD of 1.19. The pH of the reaction mixture was then slowly reduced down to 4.5 with 1.0% dilute nitric acid. An additional 60 minutes at 85 degrees Centigrade followed by cooling resulted in smooth toner particles and the toner shape factor was considered to be 121. The toner particle size after cooling the reactor contents was found to be 5.7 microns in diameter with a GSD of 1.21.

Example 3: Magenta Toner

To 310 grams of the above latex (A), comprising styrene/butylacrylate/sulfopropylmethacrylate submicron resin particle suspended in an aqueous media was simultaneously added with 100 grams of a dilute pigment dispersion comprising of 25 grams of Red 81.3 pigment stabilized by sulfonated polyester submicron particles (30% pigment and 10% sulfonated polyester) and 75 gm of water, to 400 grams of water, while being polytroned at high speeds. About 2 grams of the inorganic cationic coagulant poly aluminum chloride (10% solids in nitric acid) with 6.0 grams of aqueous nitric acid of pH=2, was added to the above mixture. 2.0 grams of the cationic organic coagulant dialkyl benzenealkyl ammonium chloride in 10 grams of water was then added and polytroned for a period of 2 minutes at speeds of 5,000 rpm. The mixture was then transferred into a reaction kettle and heated to 47 degrees Centigrade for a period of 140 minutes where the particle size as measured on a Coulter Counter was 5.6 microns with a GSD of 1.20. The pH of the slurry was then adjusted from 2.7 to 8.0 with the addition of 4% aqueous NaOH solution. The temperature of the reaction kettle was raised to 75 degrees Centigrade and held there for 20 minutes. The particle size measured was 5.7 microns with a GSD of 1.21. The temperature of the reactor was the further raised to 85 degrees and held there for 30 minutes resulting in a particle size of 5.7 microns and a GSD of 1.21. The pH of the reaction mixture was then slowly reduced down to 4.5 with 1.0% dilute nitric acid. An additional 80 minutes at 85 degrees Centigrade resulted in smooth toner particles; the toner shape factor was considered to be 120. The toner particle size after cooling the reactor contents was found to be 5.7 microns in diameter with a GSD of 1.21.

Example 4: Magenta Toner

To 310 grams of the above latex (B), comprising styrene/butylacrylate/sulfopropylmethacrylate submicron resin particle of 180 nm in diameter size (throughout the Examples unless otherwise indicated) suspended in an aqueous media was simultaneously added with 75 gram of water and 25 grams of Red 81.3 pigment dispersion stabilized by 75 nm sulfonated polyester submicron particles wherein the pigment dispersion comprises 30% pigment and 10% sulfonated polyester to 400 grams of water, while being polytroned at high speeds. 2.0 grams of the inorganic cationic coagulant poly aluminum chloride (10% solids in nitric acid) available from Vanchem, with 6.0 grams of aqueous nitric acid of pH=2, was added to the above mixture. 2.0 grams of the above cationic organic coagulant was added and the resulting mixture polytroned for a period of 2 minutes at speeds of 5,000 rpm. The mixture was then transferred into a reaction kettle and heated to 51 degrees Centigrade for a period of 110 minutes where the particle size as measured on a Coulter Counter was 5.7 microns with a GSD of 1.19. The pH of the slurry was then adjusted from 2.7 to 8 by the addition of a 4% aqueous NaOH solution. The temperature of the reaction kettle then raised to 75 degrees Centigrade and held there for 30 minutes. The particle size of the aggregates comprising styrene-butylacrylate-sulfopropylmethacrylate, pigment, and sodio sulfonated polyester resin in the ratio of 92.5:5.6:1.9 respectively was measured and found to be 5.7 microns with a GSD of 1.19. The temperature of the reactor was the further raised to 85 degrees and held there for 30 minutes resulting in an aggregate particle size of 5.6 microns and a GSD of 1.19. The pH of the reaction mixture was then slowly reduced down to 4.5 with 1.0% dilute nitric acid. An additional 70 minutes at 85 degrees Centigrade resulted in smooth surfaced toner particles and the toner shape factor was considered to be 121 as measured by a scanning electron microscope. The toner was comprised of styrene-butylacrylate-sulfopropylmethacrylate, pigment, and sodio sulfonated polyester resin in the ratio of 92.5:5.6:1.9 respectively. The toner particles size after cooling the reactor content was found to be 5.7 microns in diameter with a GSD of 1.20.

Example 5: Yellow Toner

To 310 grams of the above latex (A), comprising styrene/butylacrylate/sulfopropylmethacrylate submicron resin particle suspended in an aqueous media was simultaneously added with 100 grams of dilute pigment dispersion comprising 40 grams of Yellow 14 pigment stabilized by sulfonated polyester submicron particles (30% pigment and 10% sulfonated polyester) and 60 gm of water, to 400 grams of water, while being polytroned at high, 5,000 RPM, speeds. 2.0 grams of the inorganic cationic coagulant poly aluminum chloride (10% solids in nitric acid) with 6.0 grams of aqueous nitric acid of pH=2, was added to the above mixture. 2.0 grams of the cationic organic coagulant trialkyl benzenealkyl ammonium chloride in 10 grams of water was then added and the resulting mixture was polytroned for a period of 2 minutes at speeds of 5,000 rpm. The mixture was then transferred into a reaction kettle and heated to 47 degrees Centigrade for a period of 160 minutes where the particle size as measured on a Coulter Counter was 5.8 microns with a GSD of 1.20. The pH of the slurry was then adjusted from 2.7 to 8.0 with the addition of 4% aqueous NaOH solution. The temperature of the reaction kettle was raised to 75 degrees Centigrade and held there for 15 minutes. The measured particle size was 5.9 microns with a GSD of 1.20. The temperature of the reactor was the further raised to 85 degrees and held there for 30 minutes resulting in a particle size of 5.8 microns and a GSD of 1.20. The pH of the reaction mixture was then slowly reduced down to 4.5 with 1.0% dilute nitric acid. An additional 90 minutes at 85 degrees Centigrade resulted in smooth toner particles with a toner shape factor of 120. The toner particle size after cooling the reactor content was found to be 5.9 microns with a GSD of 1.21.

Example 6: Yellow Toner

To 310 grams of the above latex (B) comprising styrenelbutylacrylate/sulfopropylmethacrylate submicron resin particle suspended in an aqueous media was simultaneously added with 100 grams of dilute pigment dispersion comprising 40 grams of Yellow 14 pigment stabilized by sulfonated polyester submicron particles (30% pigment and 10% sulfonated polyester) and 60 gm of water, to 400 grams of water, while being polytroned at high speeds. 2.0 gram of the inorganic cationic coagulant poly aluminum chloride (10% solids in nitric acid) with 6.0 grams of aqueous nitric acid of pH=2, was added to the above mixture. 2.0 grams of the cationic organic coagulant dialkyl benzenealkyl ammonium chloride in 10 grams of water was then added and polytroned for a period of 2 minutes at speeds of 5,000 rpm. The mixture was then transferred into a reaction kettle and heated to 49 degrees Centigrade for a period of 150 minutes where the particle size as measured on a Coulter Counter was 5.7 microns with a GSD of 1.20. The pH of the slurry was then adjusted from 2.7 to 8.0 with the addition of 4% aqueous NaOH solution. The temperature of the reaction kettle was raised to 75 degrees Centigrade and held there for 30 minutes. The particle size measured was 5.7 microns with a GSD of 1.20. The temperature of the reactor was the further raised to 85 degrees and held there for 30 minutes resulting in a particle size of 5.8 microns and a GSD of 1.21. The pH of the reaction mixture was then slowly reduced down to 4.5 with 1.0% dilute nitric acid. An additional 80 minutes at 85 degrees Centigrade resulted in smooth toner particles and the toner shape factor was considered to be 121. The toner particle size after cooling the reactor contents was found to be 5.9 microns with a GSD of 1.21.

Example 7: Yellow Toner with Wax

To 310 grams of the above latex (A) comprising styrene/butylacrylate/sulfopropylmethacrylate submicron resin particle suspended in an aqueous media and 60 grams of polyethylene 725 wax dispersion comprising 30% solids, 3% anionic surfactant and 67% water, was simultaneously added with 100 grams of dilute pigment dispersion comprising 45 grams of Yellow 14 pigment stabilized by sulfonated polyester submicron particles (30% pigment and 10% of 75 nm sulfonated polyester submicron resin ) and 55 gm of water, to 400 grams of water, while being polytroned at high speeds. 3.0 gram of the inorganic cationic coagulant poly aluminutesum chloride (10% solids in nitric acid) with 6.0 grams of aqueous nitric acid of pH=2, was added to the above mixture. 1.0 grams of the anionic organic coagulant dialkyl benzenealkyl ammonium chloride in 10 grams of water was then added and polytroned for a period of 2 minutes at speeds of 5,000 rpm. The resulting mixture was then transferred into a reaction kettle and heated to 50 degrees Centigrade for a period of 150 minutes where the particle size as measured on a Coulter Counter was 5.5 microns with a GSD of 1.20. To this was added 130 grams of latex (B) was added and allowed to stir for an additional 30 minutes. The particle size of the aggregates comprising styrene-butylacrylate-sulfopropylmethacrylate, wax, pigment, and sodio sulfonated polyester resin in the ratio of 83:8.5:6.4:2.1, respectively was measured and found to be 5.7 microns with a GSD of 1.20.

The pH of the slurry was then adjusted from 2.7 to 8.0 with the addition of 4% aqueous NaOH solution. The temperature of the reaction kettle was raised to 75 degrees Centigrade and held there for 15 minutes. The particle size measured was 5.7 microns with a GSD of 1.20. The temperature of the reactor was the further raised to 85 degrees and held there for 30 minutes resulting in a particle size of 5.8 microns and a GSD of 1.20. The pH of the reaction mixture was then slowly reduced down to 4.5 with 1.0% dilute nitric acid. An additional 120 minutes at 90 degrees Centigrade resulted in smooth particles and the toner shape factor was considered to be 121. The toner particles comprising styrene-butylacrylate-sulfopropylmethacrylate, pigment, about 10 weight percent and sodio sulfonated polyester resin in the ratio of 92.5:5.6:1.9 respectively, was found to be 5.7 microns with a GSD of 1.20. No wax rejection or delayed latex was observed in the supernatant after the particles were allowed to settle overnight, about 18 hours which is an indication of total 100% wax incorporation.

Other embodiments and modifications of the present invention may occur to those of ordinary skill in the art subsequent to a review of the present application and the information presented herein; these embodiments, modifications, and equivalents, or substantial equivalents thereof, are also included within the scope of the present invention.

What is claimed is:

1. A process for the preparation of toner comprising:

(i) generating by emulsion polymerization in the presence of an initiator a first resin latex emulsion;

(ii) generating by polycondensation a second resin latex optionally in the presence of a catalyst;

(iib) dispersing the resin of (ii) in water;

(iii) mixing (iib) with a colorant thereby providing a colorant dispersion;

(iiib) mixing the resin latex emulsion of (i) with the resin/colorant mixture of (iii) to provide a blend of a resin and colorant;

(iv) adding an aqueous inorganic cationic coagulant solution of a polymeric metal salt and optionally an organic cationic coagulant to the resin/colorant blend of (iiib);

(v) heating at a temperature of from about 5 to about 10 degrees Centigrade below the resin Tg of (i), to thereby from aggregate particles and which particles are optionally at a pH of form about 2 to about 3.5;

(vi) adjusting the pH of (v) to about 6.5 to about 9 by the addition of a base;

(vii) heating the aggregate particles of (v) at a temperature of from about 5 to about 50 degrees Centigrade above the Tg of the resin of (i), followed by a reduction of the pH to from about 2.5 to about 5 by the addition of an acid resulting in coalesced toner;

(viii) optionally isolating the toner.

2. A process in accordance with claim 1 wherein subsequent to (vi) there is added a further latex comprised of resin generated by emulsion polymerization.

3. A process in accordance with claim 2 wherein subsequent to the addition of the latex there is formed a coating on the aggregates obtained in (v).

4. A process in accordance with claim 1 (ii) wherein the resulting resin is dispersed in warm water to result in a resin dispersion which dispersion is then added to colorant and mixed providing a colorant dispersion.

5. A process in accordance with claim 4 the resin forms a coating on the colorant particles thereby providing a stable colorant, and wherein (iv) is accomplished by continuous stirring while subjecting the blend to high shear, to primarily form a homogeneous gel.

6. A process in accordance with claim 1 wherein the toner is isolated.

7. A process in accordance with claim 1 the inorganic cationic coagulant is selected from the group consisting of metal complexes of sulfates, chlorides or nitrates.

8. A process in accordance with claim 1 wherein said coagulant is poly aluminum sulfosulfate, poly aluminutesumm chloride, iron oxy chloride, poly aluminutesum sulfate.

9. A process in accordance with claim 1 the organic cationic coagulant is an organic salt of dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylaminuteses, or dodecylbenzyl triethyl ammonium chloride.

10. A process in accordance with claim 1 wherein (iv), further comprises adding a wax dispersion comprised of submicron wax particles in the size range of about 80 to about 200 nm, which are stabilized by the resin of (ii), and wherein the wax particle contain a coating of the resin of (ii).

11. A process in accordance with claim 10 wherein the wax is selected from the group consisting of polyethylene, polypropylene, polyethylene/amide, polyethylenetetrafluoroethylene, and polyethylenetetraflouorethylene/amide.

12. A process in accordance with claim 1 wherein the second resin is prepared in the presence of a catalyst and said resin is selected from a group consisting of poly(1,2-propylene-sodio 5-sulfoisophthalate), poly(neopentylene-sodio 5-sulfoisophthalate), poly(diethylene-sodio 5-sulfoisophthalate), copoly-(1,2-propylene-sodio 5-sulfoisophthalate)-copoly-(1,2-propylene-terephthalate phthalate), copoly-(1,2-propylene-diethylene-sodio 5-sulfoisophthalate)-copoly-(1,2-propylene-diethylene-terephthalate-phthalate), copoly-(ethylene-neopentylene-sodio 5-sulfoisophthalate)-copoly-(ethylene-neopentylene-terephthalate-phthalate), copoly-(propoxylated bisphenol A)-copoly-(propoxylated bisphenol A-sodio 5-sulfoisophthalate) and wherein the latex resin of (i) is selected from a group consisting of poly(styrene-acrylate), poly(styrene-butadiene), poly(para-methyl styrene-butadiene), poly(meta-methyl styrene-butadiene), poly (alpha-methylstyrene-butadiene), poly(methylmethacrylate-butadiene), poly(ethylmethacrylate-butadiene), poly (propylmethacrylate-butadiene), poly(butylmethacrylate-butadiene), poly(methylacrylate-butadiene), poly (ethylacrylate-butadiene), poly(propylacrylate-butadiene), poly(butylacrylate-butadiene), poly(styrene-isoprene), poly (para-methyl styrene-isoprene), poly(meta-methyl styrene-isoprene), poly(alpha-methylstyrene-isoprene), poly (methylmethacrylate-isoprene), poly(ethylmethacrylate-isoprene), poly(propylmethacrylate-isoprene), poly (butylmethacrylate-isoprene), poly(methylacrylate-isoprene), poly(ethylacrylate-isoprene), poly (propylacrylate-isoprene), and poly(butylacrylate-isoprene) copolymers.

13. A process in accordance with claim 1 wherein the polycondensation catalyst is selected from a group of tetraalkyl titinates, diaalkyltin oxide, tetraalkyltin oxide hydroxide, dialkyltin oxide hydroxide, aluminum alkoxides, alkylzinc, dialkyl zinc, zine oxides, stannous oxide, dibutyltin oxide, dibutyltin oxide hydroxide and tetraalkyl tin in optional amounts of from about 0.01 mole percent to about 2.0 mol percent of the resin.

14. A process according to claim 1 wherein the heating in (vi) is at a temperature of from 5° C. to 10° C. below the glass transition temperature (Tg) of the latex emulsion resin of (i) to form aggregates of a diameter of from about 3 to about 15 microns with a narrow GSD 1.25, wherein the heating in (x) is conducted at a temperature of from about 5° C. to about 50° C. above the glass transition temperature (Tg) of the resin of (i) to form toner particles are comprised of resin and colorant.

15. A process according to claim 1 wherein the latex resin dispersion of (i) contains submicron resin particles having an average size diameter of about 150 to about 290 nm, wherein the high shear in (v) is from about 3,000 to about 10,0000 rpm; and wherein the toner particle obtained have an average volume diameter of from about 2 to about 15 microns.

16. A process in accordance with claim 1 wherein the initiator is ammonium persulfate, potassium persulfate, sodium persulfate, ammonium persulfite, potassium persulfite, sodium persulfite, ammonium bisulfate, potassium bisulfate, sodium bisulfate, 1,1'-azobis (I-methybutyronitrile-3-sodium sulfonate, or 4,4'-azobis (4cyanovaleric), and is selected in the amount of about 0.1 to about 10 weight percent of the monomer to be polymerized.

17. A process in accordance with claim 1 wherein said colorant is a pigment.

18. A process in accordance with claim 1 wherein said coagulant is poly aluminum chloride.

19. A process in accordance with claim 1 wherein said coagulant is poly aluminum sulfosulfate.

20. A process for the preparation of a toner comprising:

(i) generating by emulsion polymerization in the presence of an initiator a latex emulsion containing a first resin;

(ii) generating by a polycondensation reaction in the presence of a catalyst a second resin and wherein the resulting resin is dispersed in water to provide a dispersion of the second resin;

(iii) mixing the resulting resin dispersion of (ii) and a colorant wherein there is formed a coating of resin (ii) on said colorant thereby providing a stable colorant dispersion wherein optionally from about 70 to about 95 percent of colorant is coated by said resin;

(iv) blending the resin latex emulsion of (i) with the colorant/resin dispersion (iii), to form a resin latex/colorant blend;

(v) adding an aqueous inorganic cationic coagulant solution of a metal salt, an organic cationic coagulant, or mixtures thereof to the resin latex/colorant blend (iv), while continuously subjecting the blend to high shear to generate a homogeneous gel of the resin/colorant blend;

(vi) heating the sheared gel of (v) at a temperature of from about 5 to about 10 degrees Centigrade below the resin (i)glass transition temperature to form aggregate particles of resin, coagulant and colorant;

(vii) optionally retaining (vi) for a period of from about 1 to about 3 hours to primarily minimize growth of the aggregates and achieve a narrow GSD;

(viii) optionally adding a further latex comprised of resin wherein the addition of said latex enables the formation of a coating on said aggregates of (vii);

(ix) changing the pH of the said aggregates of (vii) or optionally of (viii) which is initially in the range of from about 2 to about 3.5 to a pH to about 6.5 to about 9 by the addition of a base to thereby primarily stabilize the aggregate particles from further growth;

(x) heating the aggregate particles of (ix) at temperatures of from about 5 to about 50 degrees Centigrade above the Tg of the resin (i), for an optional period of from about 0.5 to about 1 hour, followed by a reduction of the pH from about 6.5 to about 9 to a pH range of about 2.5 to about 5 with an acid to form coalesced particles of a toner composition of resin (i), resin of (ii), resin of (viii) and colorant; and (xi) isolating the toner.

21. A process in accordance with claim 20 wherein said resin (i) is submicron in size and wherein said submicron is from about 50 to about 250 nanometers in diameter; said water is warm water about 60 to about 80 degrees Centigrade; said resin of (ii) is dispersed in warm water resulting in a resin dispersion of a particle size in the range of about 30 to about 120 nanometers in diameter of and wherein the dispersion of (ii) is selected as dispersant for the colorant particles to provide a stable colorant dispersion, and resulting in a colorant/resin dispersion and wherein the coating of said second resin (iii) is from about of 10 to about 120 nm in thickness; and wherein the components of the final toner are (a) resin from latex of (i), (b) resin from (ii), (c) resin from (viii), and (d) colorant.

22. A process in accordance with claim 21, wherein the latex of (i) comprises submicron resin particles of styrene-butylacrylate-sulfopropylmethacrylate which sulfonate optionally functions act as a dispersant for said resin particles thereby providing a stable latex.

23. A process in accordance with claim 21, wherein the pH during the blending and the aggregation (iv) to (viii) is in the range of about 1.8 to 4.5.

24. A process in accordance with claim 21 (iv) to (vi), wherein an acidic pH range of from about 1.8 to 4 enables a narrow particle size distribution of said toner aggregates of (vi), wherein the size distribution thereof is in the range of from about 1.16 to about 1.24; wherein the latex (vii) is comprised of the same polymer resin composition as that of (i) or a different polymer composition and/or different molecular properties of molecular weight, molecular number, the molecular weight distribution and the Tg than that of (i), thereby providing a core shell structure on the toner particles.

25. A process in accordance with claim 21, wherein the second resin (ii) provides a resin which is dispersable in warm water wherein the temperature of said water is in the range of form about 60 to about 80 degrees Centigrade thereby providing submicron size resin particles which are in the size range diameter of from about 0.03 to about 0.12 microns in water.

26. A process for the preparation of toner comprising:

(i) generating by emulsion polymerization in the presence of an initiator a first resin latex emulsion;

(ii) generating by polycondensation in the presence of a catalyst a second resin latex;

(iib) dispersing the resin of (ii) in warm water;

(iii) mixing (iib) with a colorant;

(iiib) mixing the resin latex emulsion of (i) with the resin/colorant mixture of (iii);

(iv) adding a coagulant or mixtures;

(v) heating 10 below the resin Tg of (i);

(vi) adjusting the pH of (v) to about 6.5 to about 9 by the addition of a base;

(vii) heating above the Tg of the resin of (i), followed by a reduction of the pH to from about 2.5 to about 5 by the addition of an acid resulting in coalesced toner; and (viii) isolating the toner.

27. A toner process which comprises mixing a first and second resin with a colorant; adding a coagulant or a mixture of coagulants; heating at a temperature below the first resin Tg; adding a base and heating at a temperature of above the Tg of said first resin.

* * * * *